United States Patent [19]

Latimer

[11] 3,987,703

[45] Oct. 26, 1976

[54] COMBINED RESTRICTOR AND DEAD ENGINE LOWERING VALVE

[75] Inventor: Eugene E. Latimer, Wilmington, Ill.

[73] Assignee: Caterpillar Tractor Co., Peoria, Ill.

[22] Filed: Aug. 12, 1974

[21] Appl. No.: 496,477

[52] U.S. Cl. ..... 91/6; 91/411 R; 91/461; 137/118

[51] Int. Cl.[2] ..... F15B 11/16; F15B 13/06

[58] Field of Search ..... 91/6, 451, 461, 304, 91/411; 60/403, 404; 137/112, 113, 118

[56] References Cited

UNITED STATES PATENTS

| | | | |
|---|---|---|---|
| 2,946,347 | 7/1960 | Ruhl | 91/451 X |
| 3,215,156 | 11/1965 | De Corte et al. | 137/113 X |
| 3,350,986 | 11/1967 | Berta et al. | 91/414 |
| 3,604,313 | 9/1971 | Fruehauf | 91/438 |
| 3,620,129 | 11/1971 | Fruehauf | 91/461 X |
| 3,738,107 | 6/1973 | Miller | 137/112 X |
| 3,780,623 | 12/1973 | Hohlein | 91/461 |
| 3,862,643 | 2/1973 | Dezelan et al. | 91/461 X |

*Primary Examiner*—Irwin C. Cohen
*Attorney, Agent, or Firm*—Phillips, Moore, Weissenberger, Lempio & Strabala

[57] ABSTRACT

A hydraulic control system having a load-lifting hydraulic motor, a source of pressurized fluid and a pilot-operated directional control valve for directing fluid for operation of the motor is provided with a combined restrictor and shuttle valve assembly that is operative to direct fluid from a pump for pilot-operation of the main control valve when the pump is in operation, but is operative upon failure of the pump system to provide pressure from the load-lifting side of the lifting motors to a pilot control valve for pilot operation of the directional control valve. This assembly provides an emergency source of hydraulic pilot fluid for pilot operation of the main control valve for lowering the implements or load supported by the hydraulic motors should the engine of the vehicle fail.

5 Claims, 1 Drawing Figure

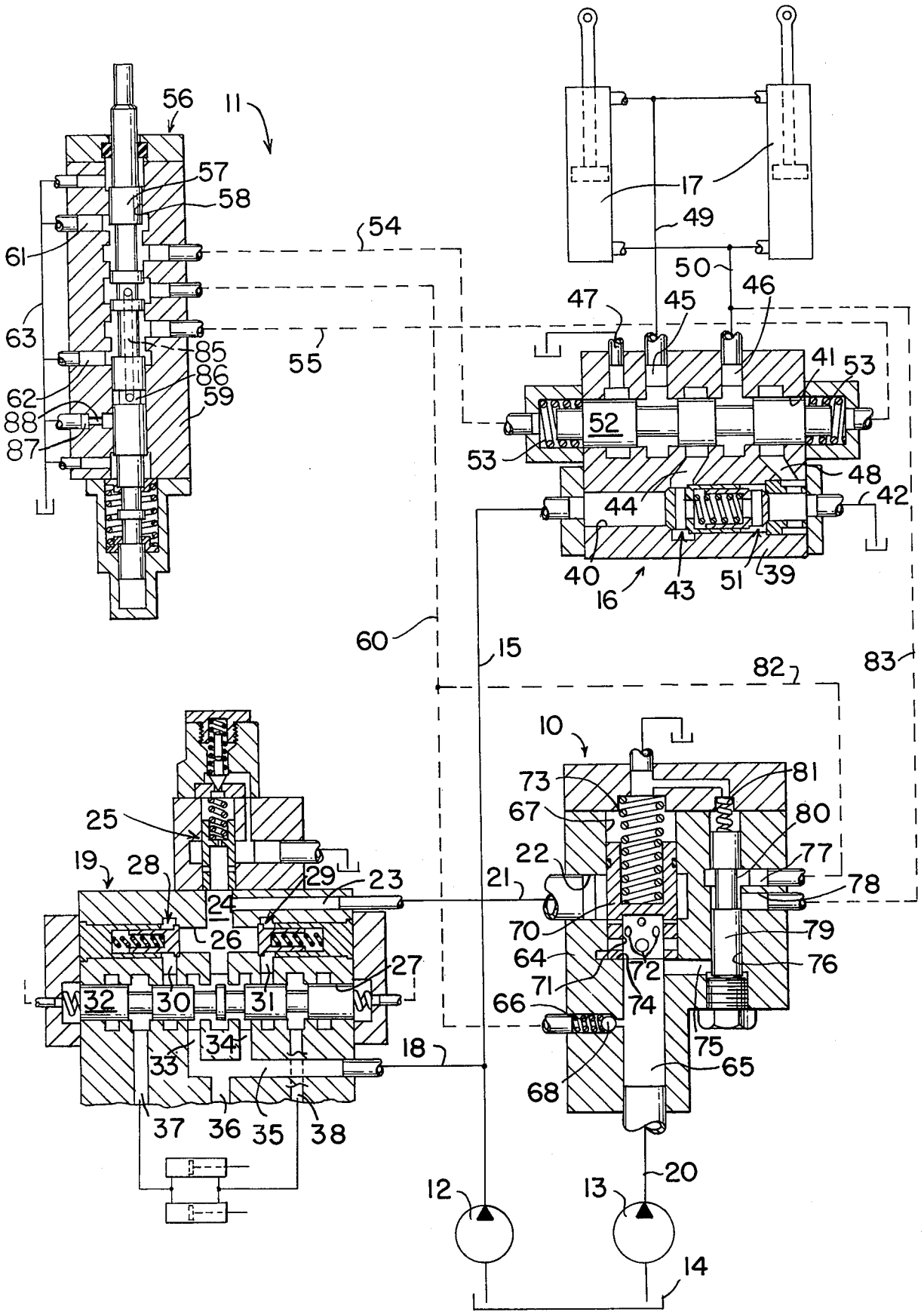
11
56
57
58
61
63
62
88
87
85
86
59
54
55
17
49
50
46
47
45
41
53
52
53
48
42
44
40
16
43
51
39
60
15
82
83
10
73
81
67
80
77
78
22
21
70
79
64
72
76
71
74
66
75
65
68
20
25
19
28
29
23
24
26
27
32
30
31
34
33
18
37
36
35
38
12
13
14

COMBINED RESTRICTOR AND DEAD ENGINE LOWERING VALVE

BACKGROUND OF THE INVENTION

The present invention is directed to pilot-operated control valve systems and particularly to means for diverting pressurized fluid resulting from the supporting of a load for pilot operation of the system.

Large hydraulic control systems typically employ pilot operation of directional control valves for controlling the system. Such a pilot operation provides systems that require low effort on the part of the operator and thus enhances the ease of operation and control as well as permits remote location of main control valves from the operator compartment. Such systems, however, provide problems for portions of the system that lift and support large loads, such as implements or loads such as loaded implements.

Typically, the pilot control pressure is supplied by a pilot pump that is separate from the main fluid supply system. Such separate pump normally adds considerable expense to the machine.

With the prior art systems, should the engine fail and thus the pump for supplying the pilot fluid become inoperative while the implements or load of the system is in a raised position, no means is readily available for lowering the load. Such raised load or implement can become dangerous in the raised position should it suddenly fall because of rapid leak-out of the fluid in the cylinders.

It is therefore desirable to provide some means for controllably lowering the load or implements of such a machine should the pilot control pressure fail. Some such systems are known; however, they provide numerous disadvantages. One such system is shown in, for example, U.S. Pat. No. 3,620,129 issued to W. G. Fruehauf Nov. 16, 1971.

SUMMARY AND OBJECTS OF THE INVENTION

It is a primary object of the present invention to provide a pilot-controlled hydraulic system having load-supporting cylinders with a valve assembly operative to automatically provide an emergency source of pilot pressure upon failure of the main pilot system.

A further object of the present invention is to provide a pilot-operated control system with a novel valve assembly that is operative to divert a portion of the main supply fluid for pilot operation of the directional control valves for a normal operation thereof and, upon failure of the supply systems to direct pressurized fluid from the load-supporting motors for pilot operation of the system for emergency lowering of the load.

In accordance with the primary aspect of the present invention, a pilot-operated hydraulic system for load-supporting hydraulic motors is provided with a valve assembly that is operative to divert fluid from the main supply system for pilot operation of the directional control valves and is operative automatically upon failure of that system to provide pressurized fluid from the pressure side of the loadsupporting motors for emergency pilot operation of the directional control valves.

BRIEF DESCRIPTION OF THE DRAWINGS

The above and other objects and advantages of the present invention will become apparent from the following description when read in conjunction with the accompanying drawings wherein the single FIGURE is a schematic layout of a hydraulic system embodying the present invention.

DETAILED DESCRIPTION OF PREFERRED EMBODIMENTS

Referring now to the drawings, a combined restrictor and dead engine lowering valve is indicated generally at 10 in combination with a pilot-operated hydraulic implement system, partially illustrated generally at 11, for earth-moving machines or the like, not shown. The implement system includes a pair of main fluid supply pumps 12 and 13 which may be of the fixed-displacement type which draw fluid from a common fluid reservoir 14.

A conduit 15 is connected for directing pressurized fluid from the pump 12 to a pilot-actuated directional control valve 16 which is operatively connected for controlling a pair of implement jacks 17. A branch conduit 18 connected to conduit 15 directs fluid to another pilot-actuated control valve 19 for controlling other implements or functions not shown.

A conduit 20 is connected for directing fluid from the pump 13 to the combined restrictor and lowering valve 10. A conduit 21 interconnects an outlet port 22 of the valve 10 with an inlet passage 23 of the valve 19 for supplying fluid thereto.

The passage 23 is connected to a passage 24 which communicates the fluid pressure to a relief valve 25 for relieving undue pressures in the system and to a pair of bores 26 and 27 in valve 19. A pair of load check valves 28 and 29 are individually mounted between the opposite ends of the bore 26 and a pair of passages 30 and 31 to permit flow from the bore to the passages, but block flow in the reverse direction. Passages 30 and 31 are connected to the bore 27 at predetermined spaced axial positions on the opposite sides of the passage 24. A valve spool 32 is slidably disposed within the bore 27 and is adapted to permit communication between the passage 24 and a pair of passages 33 and 34 when the spool is in a neutral position, as shown. Passages 33 and 34 are connected to a passage 35 to which conduit 18 is connected. Passage 35, in turn, is connected to a passage 36 which directs fluid pressure to another control valve, not shown.

A pair of passages 37 and 38 are connected to the opposite ends of a pair of other implement motors or jacks, not shown, for directing fluid pressure to one end thereof when the valve spool 32 is actuated in one direction and for directing fluid pressure to the opposite end when the valve spool is actuated in the opposite direction. In a manner similar to that described in U.S. Pat. No. 3,350,986, the volume of fluid discharged from these jacks is combined with the fluid being directed to the valve, not shown, through passage 36 to increase the fluid supply thereto.

The implement control valve 16 includes a valve body 39 having a pair of bores 40 and 41 formed therein. Conduit 15 is connected to one end of the bore 40 and a drain conduit 42 is connected to the opposite end thereof. A load check valve 43 is mounted within the bore 40 for admitting fluid from the conduit 15 to the bore 41 through a passage 44. Also communicating with the bore 41 are a pair of motor ports 45 and 46 and a pair of drain passages 47 and 48. A pair of conduits 49 and 50 individually interconnect the motor ports 45 and 46 to the rod and head ends, respectively, of the implement cylinders 17. Drain passage 48 interconnects the bore 41 with bore 40 for returning fluid from the head ends of the cylinders to the tank 14 by way of the conduit 42.

A make-up valve 51 is also disposed within the bore 40 for communicating such return fluid with the inlet passage 44 in a manner such as disclosed in U.S. Pat. No. 3,779,133. A valve spool 52 is slidably mounted within the bore 41 and is adapted to be positioned in either the lower, hold or raise position of implement jack operation. The spool 52 is normally biased to its central hold position by a pair of springs 53 disposed at the opposite ends of the valve spool.

The spool is actuated to its lower or raise positions by pilot pressure communicated against the opposite ends of the spool through a pair of conduits 54 and 55. Such conduits interconnect the opposite ends of the valve spool 52 with a pilot control valve 56. Such pilot valve includes a manually positionable valve spool 57 which is slidably mounted within a bore 58 formed in a housing 59 thereof. Such valve spool is effective in selectively communicating pilot pressure from a pilot supply conduit 60 connected to the bore 58 to either of the conduits 54 or 55 while exhausting fluid from the other of such conduits through respective drain ports 61 and 62 connected to a drain conduit 63. A passage 85 is provided in the valve spool 57 to communicate pilot pressure from conduit 60 to an annular recess 86. A restricted drain port 87 having an orifice 88 is registerable with the annular recess 86 when the valve spool is positioned to communicate pilot pressure from the conduit 60 to conduit 54.

The combined restrictor and dead engine lowering valve 10 includes a valve body 64 having an inlet port 65 to which conduit 20 is connected for receiving fluid pressure from the pump 13. The inlet port communicates fluid with an outlet passage 66 and one end of a bore 67. The outlet passage is connected to conduit 60 and is provided with a check valve 68 for permitting fluid flow from the passage to the conduit, but preventing flow in the opposite direction.

A dump spool 70 is slidably mounted in the bore 67 and is provided with a blind bore 71 having a plurality of radially disposed holes or ports 72 of varying sizes formed therethrough. The dump spool 70 is normally biased by a spring 73 against a shoulder 74 which positions the ports 72 of the dump spool below the outlet port 22 to block communication of the inlet port 65 with the outlet port. A passage 75 also interconnects the inlet passage 65 with one end of a second bore 76. The second bore is connected with a pair of passages 77 and 78. A shuttle valve 79 is slidably mounted within the bore and includes a reduced diameter portion 80. The shuttle valve 79 is normally biased by a spring 81 to a position so that its reduced diameter portion permits communication between the passages 77 and 78. A pair of conduits 82 and 83 individually interconnect the passages 77 and 78 with the conduits 60 and 50, respectively.

In operation, pressurized fluid supplied from the pump 12 is directed through conduits 15 and 18 for supplying fluid pressure to the control valves 16 and 19, respectively. Fluid discharged from the pump 13 is directed via conduit 20 to the inlet port 65 of the combined restrictor and dead engine lowering valve 10. Fluid in the inlet port 65 is directed through the check valve 68 in the passage 66 for communication through the conduit 60 to the pilot valve 56. Such fluid is also communicated through passage 75 against the adjacent end of the shuttle valve 79 which is effective in shifting the shuttle valve to block communication between passages 77 and 78. Fluid pressure generated by the pump 13 in excess of that needed for the operation of the pilot valve 56 and for the shifting of the shuttle valve 79 is effective in shifting the dump spool 70 upwards to a position to communicate the ports 72 with the outlet port 22 for directing such excessive fluid pressure to the control valve 19 via conduit 21.

In the event of a dead engine or the failure of the implement pump 13, there would not normally be any fluid pressure to the pilot valve 56 via conduit 60 in order to actuate the control valve 16 to enable the lowering of the implement lift jacks 17.

The construction of the present invention overcomes this problem by utilizing the load generated pressure in the head ends of the implement jacks for supplying pilot pressure to the pilot valve 56 upon failure of pump 13. This is accomplished by the automatic shifting of the shuttle valve 79 by the spring 81 in the absence of pressure in passage 75, which permits communication between passages 77 and 78 to direct fluid pressure from the conduit 50 to the conduit 60 via conduits 82 and 83. Fluid pressure in conduit 60 is prevented from escaping through passage 66 to inlet 65 and then to tank through conduit 20 and pump 13 by the check valve 68.

Pressure to pilot valve 56 allows such valve to shift the spool 52 of the implement control valve 16 so that motor port 46 is in communication with passage 48 and motor port 45 is in communication with passage 44. Fluid expelled from the head or load-supporting ends of the implement jacks is communicated to the rod ends through the make-up valve 51 in order to permit the lowering of such jacks even though no pump pressure exists.

After lowering the implement to the ground, pressure in the head ends of the jacks 17 drops to a point where the force of the pilot pressure afforded thereby acting on the valve spool 52 of the direction control valve 16 is insufficient to overcome the force of the centering spring 53 which causes the spool to return to its neutral position. As a consequence, a small amount of residual pressure may still remain in the head ends of the jack even though the implement is fully grounded which may be hazardous to personnel disassembling the implement system for servicing or repair purposes. Such residual pressure is effectively relieved by holding the spool 57 of the pilot valve 56 in its actuated position a brief time after grounding of the implement which communicates conduits 54 and 60 with the drain port 87 via passage 85 and annular recess 86 to allow the bleeding off of such pressure through the orifice 88 to tank. The size of the orifice 88, however, is sufficiently small so as not to hinder the effectiveness of the load generated pilot pressure in lowering the implement jacks by bleeding such pressure too rapidly to tank.

I claim:

1. In a hydraulic control system the combination comprising:

a first load-lifting hydraulic motor;

a first pilot-operated directional control valve for directing fluid for operation of said first motor;

a pilot valve for operating said first directional control valve; a second hydraulic motor;

a second pilot-operated directional control valve for selectively directing fluid to a pair of motor control passages leading to said second motor;

a first pump communicating pressurized fluid to said first and second directional control valves and providing a source of pressurized fluid for operation of said first motor;

a second pump connected to the inlet of said second directional control valve and to said pilot valve for providing a first source of pilot fluid;

a shuttle valve assembly including a valve housing having first and second parallel bores formed therein, an inlet communicating said first bore with the load side of said first hydraulic motor and an outlet communicating said first bore with the inlet of said pilot valve for providing a second source of pilot fluid, a first spool disposed in said first base for controlling fluid flow between said inlet and said outlet defining said first shuttle valve and normally biased by a spring means to an open communicating position between said inlet and said outlet, an inlet communicating said second pump coaxially with said second bore at one end thereof, a first outlet passage of said second bore for communicating fluid from said inlet to said pilot valve, a second outlet passage of said second bore for communicating fluid from said inlet of said second bore to said first bore at one end of said first spool for biasing said first spool to a blocking position, a third outlet passage of said second bore in said valve housing for communicating said second bore with said second direction control valve, and, a second spool reciprocably mounted in said second bore and normally biased by a spring means to a first position for blocking communication of fluid between the inlet and the third outlet of said second bore, said second spool being actuatable to a second position in response to fluid from said second pump to direct a portion of said fluid therefrom to said second direction control valve and provide a second source of pressurized fluid to said second directional control valve.

2. The hydraulic control system of claim 1 including check valve means disposed within said first outlet passage of said second bore to permit the flow of fluid from said inlet of said second bore to said pilot valve, but blocking flow in the opposite direction.

3. The hydraulic control system of claim 1 wherein said pilot valve includes;

restrictive drain means; and means selectively communicating said second source of pilot fluid with said drain means to relieve residual pressure from said second source of pilot fluid.

4. The hydraulic control system of claim 3 wherein said pilot valve includes;

a valve housing having a bore formed therein;

a valve spool reciprocably mounted in said bore and selectively actuatable to a first position for directing pilot fluid to actuate said first directional control valve for raising a load carried by said motor and to a second position to actuate the control valve for lowering said load.

5. The hydraulic control system of claim 4 wherein said drain means includes;

a drain passage provided in said valve housing of said pilot valve communicating with said bore;

a passage provided in said valve spool registerable with said drain passage when said valve spool is in its second position; and orifice means provided in said drain passage of a size sufficiently small so as not to hinder the effectiveness of said second source of pilot fluid for lowering said load in the absence of said first source of pilot fluid.

* * * * *